US008201685B1

(12) United States Patent
Licari

(10) Patent No.: US 8,201,685 B1
(45) Date of Patent: Jun. 19, 2012

(54) HANGER PACKAGING SYSTEM

(76) Inventor: Yaffa Licari, New York, NY (US)

( * ) Notice: Subject to any disclaimer, the term of this patent is extended or adjusted under 35 U.S.C. 154(b) by 272 days.

(21) Appl. No.: 12/704,841

(22) Filed: Feb. 12, 2010

Related U.S. Application Data

(60) Provisional application No. 61/151,918, filed on Feb. 12, 2009.

(51) Int. Cl.
*B65D 85/00* (2006.01)

(52) U.S. Cl. ..... 206/300; 206/497; 223/85

(58) Field of Classification Search ..... 206/279, 206/284, 285, 300, 497, 806; D6/315, 318, D6/319; 223/85–88, 98, DIG. 4; 229/87.01, 229/87.03

See application file for complete search history.

(56) References Cited

U.S. PATENT DOCUMENTS

| | | | | | |
|---|---|---|---|---|---|
| 1,591,087 | A * | 7/1926 | Holliday | ..... | 206/300 |
| 2,976,990 | A * | 3/1961 | Nevai | ..... | 206/300 |
| 3,357,544 | A * | 12/1967 | Gingher | ..... | 206/300 |
| 5,996,791 | A * | 12/1999 | Bibby et al. | ..... | 206/497 |
| 6,230,904 | B1 * | 5/2001 | Licari | ..... | 206/497 |
| 6,772,880 | B2 * | 8/2004 | Beverly | ..... | 206/300 |
| 2010/0025439 | A1 * | 2/2010 | Diamond et al. | ..... | 223/85 |

* cited by examiner

*Primary Examiner* — Luan K Bui
(74) *Attorney, Agent, or Firm* — Levisohn Berger LLP

(57) ABSTRACT

A hanger packaging system that includes a plurality of hangers having at least one projection extending from their main bodies The hangers are grouped together such that their respective projections are aligned with one another. A shrink-wrap sleeve is applied over the group of hangers. The projections are covered by the shrink-wrap and they act as a catch for trapping the same This prevents the shrink-wrap from retreating and slipping off the hanger. The hangers also have engagement means for temporarily connecting to one another. This allows for hangers to be handled as unitary groups during production.

7 Claims, 3 Drawing Sheets

HANGER PACKAGING SYSTEM

RELATED APPLICATIONS

This application claims the benefit of U.S. Provisional Appl. Ser. No. 61/151,918, filed on Feb. 12, 2009—the contents of which are fully incorporated by reference herein

FIELD OF THE INVENTION

The current invention relates to the field of packaging hangers, more specifically to a shrink-wrap package and label for a plurality of hangers.

BACKGROUND OF THE INVENTION

Clothes hangers are widely used for storing and hanging a variety of clothes such as jackets, shirts, sweaters, trousers and the like. Because of their pervasiveness in homes, businesses and schools, hangers have become staple consumer items.

Plastic hangers, which are sturdy and relatively inexpensive, are sold as necessity items in virtually all variety stores, discounters and supermarkets. These hangers are typically sold in packages comprising several hangers A package of such hangers usually entails several hangers aligned, with a cardboard collar or wrapper, banding them together.

There are numerous deficiencies associated with this packaging design From a marketing and aesthetic perspective, the cardboard collars offer a very limited opportunity to brand or label the hangers with attractive graphics and/or logos In addition, the cardboard collars add substantial cost to the finished product due to the increase in manpower required to manually apply them and due to the cost of materials. Typically, at least two operators are required for packaging finished hangers at a production facility One operator untangles hangers—which tend to catch and entangle with each other as they are released—and arranges a plurality of hangers into a group. Another operator takes the groups and applies a cardboard collar. These manpower costs are added to the price of a package of hangers. Additionally, the cardboard materials are relatively expensive.

There therefore is a need for hanger packaging that is capable of carrying attractive designs and graphics, is conducive to automation and which enhances the overall presentation of a package of hangers.

SUMMARY OF THE INVENTION

To achieve these and other benefits, a hanger wrapper is disclosed, which comprises a shrink-wrap sleeve that is inexpensive, is amenable to a host of graphic possibilities and is applied to a stack of hangers in an automated fashion The shrink-wrap sleeve of the invention is rectangular-shaped and adapted to receive a section of the main body of a hanger. The sleeve can be applied to a group of hangers in an automated fashion, thereby reducing manpower needs and, consequently, reducing its production costs Once the shrink-wrap sleeve is placed over a group of hangers, it is passed through a heat tunnel, which heats the wrapper and causes it to shrink around the hangers Each hanger is provided with a male engaging member on one side and a female engaging member on the other side. Two or more hangers placed front to back will thus align such that the male engaging member of one hanger is positioned to connect to a female receptacle of a second hanger. A desired number of hangers so aligned, are pressed together such that the members engage with one another and are joined together as a single group. In this manner groups of hangers could be handled by automated machinery as unitary groups.

In order for hangers to be wrapped in accordance with the invention, they are provided with at least one projection or nub on their main body. When several hangers are grouped in a front-to-back orientation, the projections on the hangers align with each other When the sleeve is heated, the material shrinks and tightens around and effectively captures the projections. This ensures that the shrink-wrap does not retreat and slip off the hangers.

The shrink-wrap sleeve covers a significant portion of the hanger and as such provides an expansive platform to creatively display graphics, designs, logos and the like. This allows for a novel presentation, and importantly, reduces the cost of production.

DETAILED DESCRIPTION OF THE INVENTION

Figure 1:
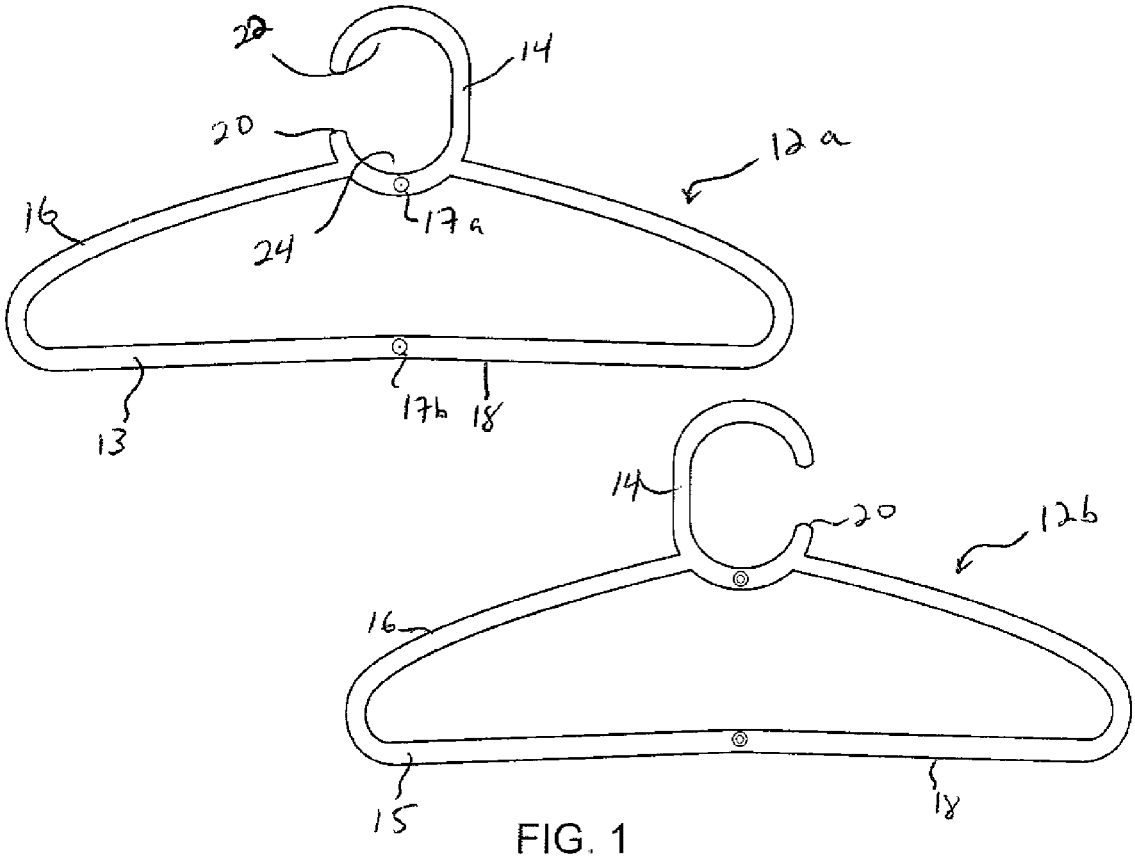
FIG. 1 is a schematic view of a hanger, showing the front and back thereof. The hanger comprises an upper projection in accordance with an embodiment of the invention.

The following is a detailed description of the preferred embodiments of the invention, reference being made to the drawings in which the same reference numerals identify the same elements of structure in each of the several figures.

FIG. 1 shows each side a plastic tubular hanger 12 For the purpose of simultaneously showing both sides of the hanger 12, the front 13 and back 15 of the hanger are shown as minor images of each other. (Note that the term "front" and "back" denote that the two hanger sides are not identical. One side comprises an engagement or attachment means that is complementary to a second side. For example, if a "front" is provided with a male engagement member, the "back" is provided with a complementary female receptacle—and vice versa. Hangers are therefore referred to as aligning in a "front-to-back" orientation The term "front," "back," "side" and "face" all refer to the hanger area shown in FIGS. 1-3.)

As shown hanger 12 comprises a hook portion 14, two sloping shoulder members 16, and a bottom support member 18. Sloping members 16 and support member 18 comprise the main body of the hanger—with the hook member centrally disposed atop thereof A projection 20 extends upward from the general area in which one of sloping members 16 joins with hook member 14 As shown, member 14 comprises a "C" shaped hook The top portion 22 of the "C" shaped hook is rounded and sized and shaped to roughly accommodate a dowel or rod for hanging purposes. The bottom portion 24 roughly mirrors top portion 22, and comprises an inverted hook, which terminates in projection 20. It will be understood by those of ordinary skill in the art that a projection could be provided in any of a variety of configurations. Projection 20 serves as a point for catching a shrink-wrap sleeve, and will be explained in greater detail below.

In the inventive system, each hanger comprises a means of engaging with, and temporarily connecting to a neighboring hanger. To that end, in one embodiment, each hanger is provided with a male engaging member on one side and a female engaging member on the other. For example, referring to FIG. 1, hanger 12*a* is shown having two male engaging members 17. The reverse side 15 is shown having two corresponding female receptacles 19 that are adapted to receive the male members 17 of a corresponding hanger (The term "engagement member" herein refers to at least one part of an engagement system—such as either the male or female portion of an attachment system)

Figure 2:
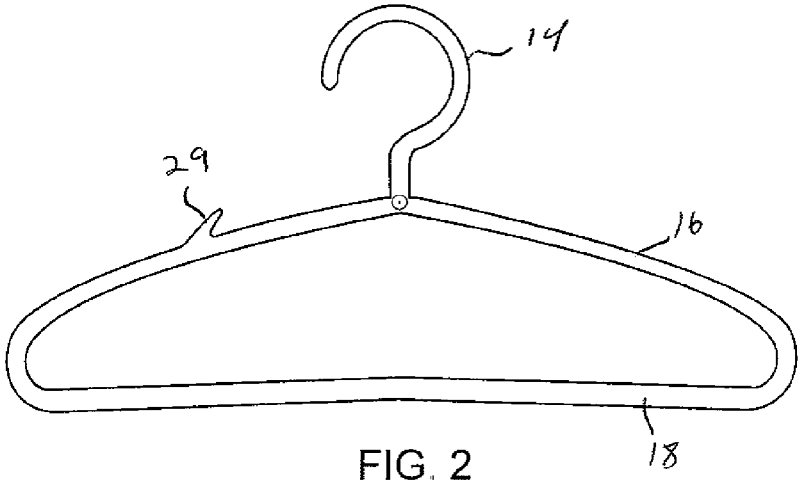
FIG. 2 is a schematic, front view of a hanger having an upper projection according to an embodiment of the invention.

In one preferred embodiment at least two engagement sites are provided on each hanger side—such as is shown in FIG. 1, whereby one male engaging member 17*a* is provided toward the top of the main hanger body and a second member 17*b* is provided toward the bottom thereof (e.g. on the bottom support member). One of ordinary skill in the art would recognize that one engagement site may be sufficient (for example as shown in FIG. 2) In other embodiments, more than two engaging members may be provided on each hanger face (not shown). Moreover, engagement sites may be located in the upper portion of the hanger side (FIG. 2) or in the lower portion thereof (FIG. 3)

In will be understood by those of ordinary skill in the art that any of several means of temporarily joining hangers, such as for example, snaps, hooks, Velcro and the like may utilized for temporarily joining hangers. Alternatively removable glue drops or other temporary adhesives such as two-sided tape may be utilized FIG. 2 shows another embodiment of the invention, whereby a projection 29 is provided on one or both of sloping members 16. As shown, a hook or similar projection is integrally formed on sloping member 16. The hook 29 (or such similar nub or projection) serves as a catch around which shrink material is tightened. This presents an impediment for the tightened wrapper and prevents it from slipping off the hangers.

Figure 3:
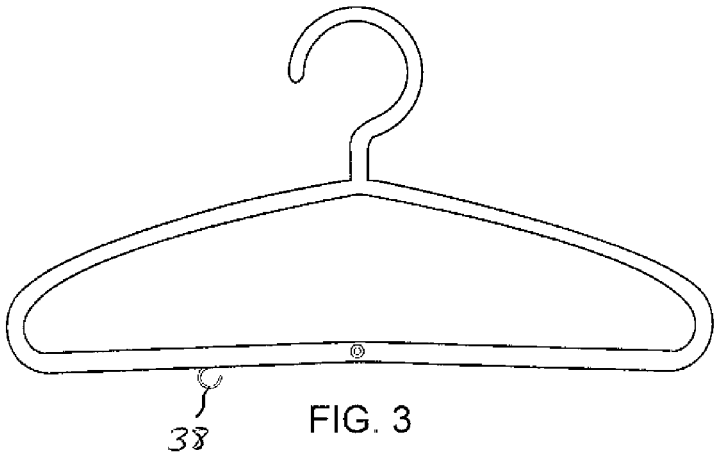
FIG. 3 is a schematic, front view of a hanger having an lower projection according to an embodiment of the invention.

FIG. 3 shows a hanger a having a hook 38 positioned on the lower surface of bottom support member 18. Hook 38 serves as a projection for trapping the shrink sleeve, thereby preventing the same from retreating from the hangers It will be understood that any of various lower projections, such as one or more nubs, would serve the purpose of acting as a catch for the shrink material.

Figure 4:
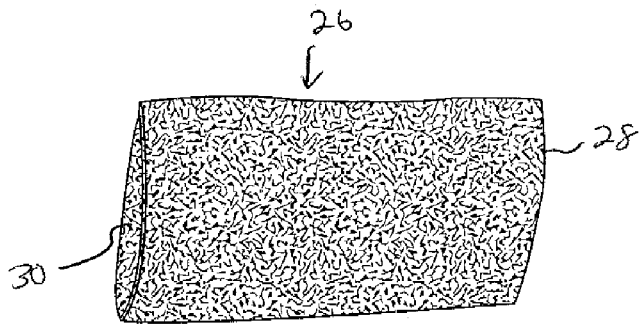
FIG. 4 is a schematic, front view of a shrink-wrap sleeve of FIG. 3
Figure 5:
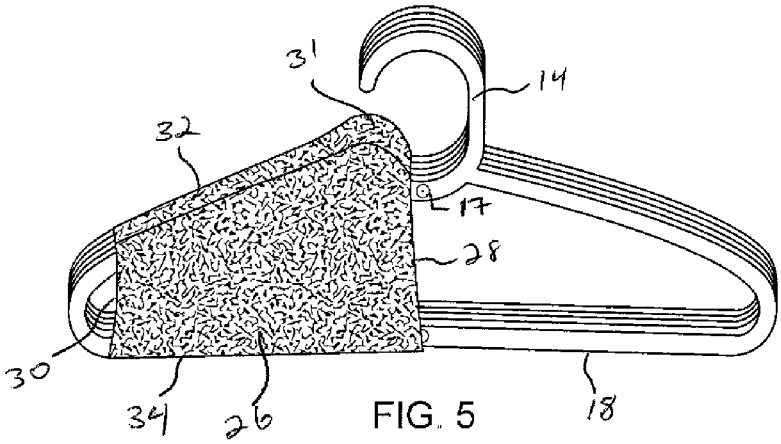
FIG. 5 is a perspective, front view of a package of hangers according to an embodiment of the invention.

FIG. 4 shows a shrink-sleeve 26 according to an embodiment of the invention. As shown, sleeve 26 comprises a roughly rectangular shaped wrapper. In other embodiments (not shown), it could be frusto-conical shaped wrapper Shrink-sleeve 26 is sized and shaped to fit over at least a quarter of the length of the main body of a plurality of hangers. In other embodiments the shrink-sleeve is sized to cover roughly half of the length of a hanger. Sleeve 26 comprises a first end comprising an opening 28 and a second end 30, which may optionally be open or closed In a preferred embodiment second end 30 is open, thus allowing for some portion of the hanger to protrude therefrom In FIG. 5, a group of hangers of the type shown in FIG. 1, is shown wrapped by sleeve 26 in accordance with an embodiment of the invention. As is known in the art of shrink-wrapping, the sleeve is applied loosely over a portion of the hangers Thereafter, the sleeve is heated, which causes it to tighten around the hangers. FIG. 5 shows a group of hangers with sleeve 26 tightly secured thereon. As shown, the area 31 where projections 22 are aligned, presents a surface to be surround by shrink wrap material. In the finished product, the top portion 32 of shrink-sleeve 26 slopes downward from the first end 28 to the second end 30, substantially matching the slope of shoulder member 16. The bottom portion 34 of sleeve 26 extends from first end 28 to second end 30 in a relatively straight line—substantially conforming to bottom support member 18

FIG. 5 shows an embodiment of the invention where sleeve 26 covers roughly half the length of the main body of a plurality of hangers and tightly binds them together It will be understood by those of ordinary skill in the art, however, that it is not necessary for the sleeve 26 to encompass half of the length of a hanger and that sleeves that are sized to cover smaller sections of a hanger could be utilized in accordance with this invention. For example, a sleeve could be provided that covers a quarter, a third or other segments of a hanger. Obviously, the more area covered by a sleeve allows for more expansive graphic possibilities due to the increased surface area available for graphical content It will be understood by those of ordinary skill in the art that unlike a cardboard collar or band as found in the prior art, the shrink-sleeve of the current invention is adaptable to accommodate varying numbers of hangers. Prior art cardboard bands are sized to accommodate a specific number of hangers. With the current invention, however, because the wrapper is shrunk around a group of hangers—there is some leeway as to how many hangers could be included in a group The shrink-sleeve will shrink more if fewer hangers are present and it will shrink less if a greater number of hangers are present—thus being adaptable to package hangers of varying quantities.

Figure 6:
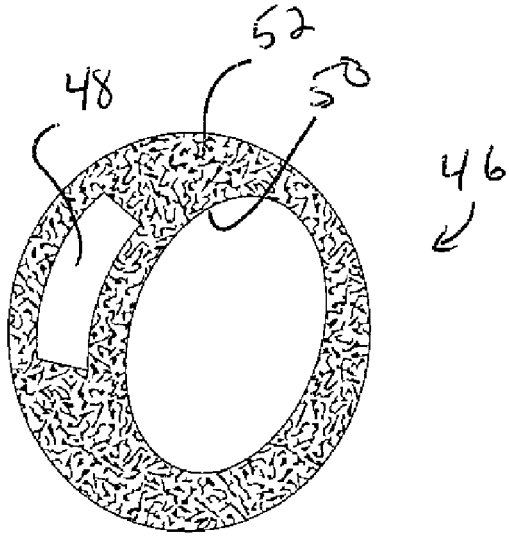
FIG. 6 is a side, perspective view of a shrink band according to an embodiment of the invention.

In FIG. 6 a shrink band 46 is shown for wrapping hangers according to another embodiment of the invention. As shown band 46 comprises a circular strip of shrink material having an opening 48 or aperture. Band 46 comprises an inside surface 50 for contacting hangers and an outside surface 52 for displaying artwork, logos or designs Band 46 is loosely placed around a group of several hangers—with their respective hooks 14 protruding through window 48. Thereafter, the band is heated such that it tightly shrinks around the hangers.

Figure 7:
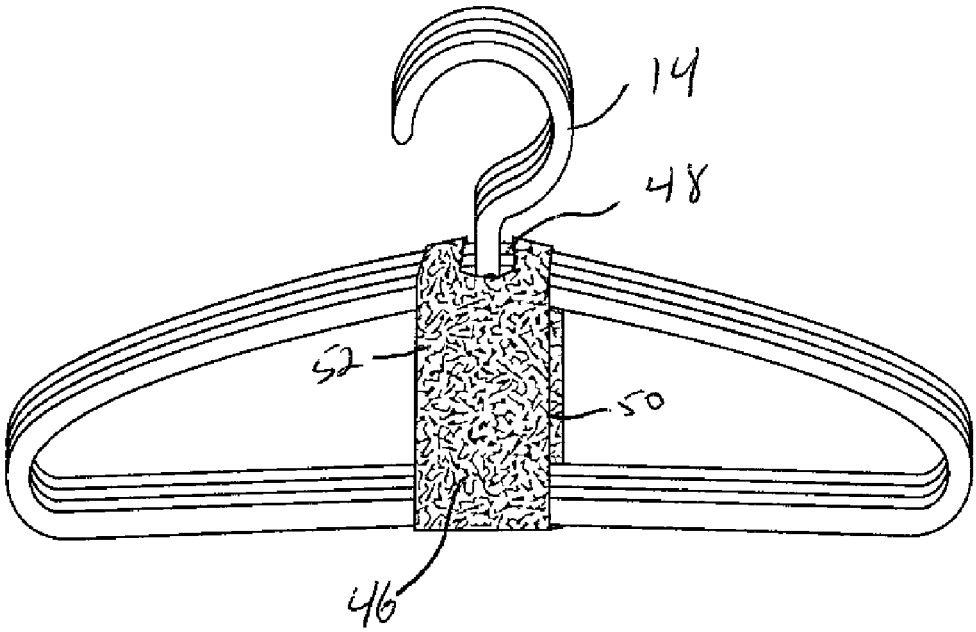
FIG. 7 is front, perspective view of a package of hangers banded together with the band of FIG. 6.

FIG. 7 shows band 46 surrounding the central portion of a group of hangers The hooks 14 are shown projection through opening 48 It will be understood by those of ordinary skill in the art that band 46 could be provided in any of various widths A wider band provides greater area for branding or designs The process of packaging hangers in accordance with this invention can be easily automated, unlike the application of the cardboard bands of the prior art. With the current invention, a group of hangers is placed into a trough or similar receptacle and are positioned to receive a sleeve or a band. A machine dispenses a sleeve or a band around the group of hangers, which is then automatically delivered into a heat tunnel for shrinking the sleeve or band around the hangers. This negates the need for a human operator The placement of a cardboard collar is a process that is not subject to automation, as an operator must lace the hook portion of hangers through the cardboard collar. In addition, the collar must be mechanically closed around hangers—typically by inserting a tab into a corresponding insertion point This cannot be easily automated. In addition, because the shrink sleeves are heated to conform to a group of hangers—one size sleeve (or band) could be utilized for packaging various numbered groups.

Having described this invention with regard to specific embodiments, it is to be understood that the description is not meant as a limitation since further modifications and variations may be apparent or may suggest themselves to those skilled in the art. It is intended that the present application cover all such modifications and variation as fall within the scope of the appended claims.

What is claimed is:

1. A hanger packaging system, comprising:

a plurality of hangers, each of said hangers having a hook member, two sloping members, a bottom support member and a front surface and a back surface and at least one projection to be covered by a shrink wrap sleeve, each of said hangers further comprising an engagement member disposed on said front thereof and an engagement member disposed on said back thereof; and a shrink wrap sleeve sized and shaped to receive a portion of said hangers.

2. The system of claim 1, further comprising an area where at least one of said sloping members joins with said hook member.

3. The system of claim 2, wherein said projection extends from said area where said sloping member joins with said hook member.

4. The system of claim 1, wherein said projection is disposed on at least one of said sloping members.

5. The system of claim 1, wherein said projection is disposed on said bottom support member.

6. The system of claim 1, wherein said engagement member disposed on said front surface comprises a male engagement member and said engagement member disposed on said back surface comprises a female receptacle.

7. The system of claim 1, wherein said engagement member disposed on said front surface comprises a female receptacle and said engagement member disposed on said back surface comprises a male engagement member.

* * * * *